United States Patent [19]

Klebba

[11] 4,027,432

[45] June 7, 1977

[54] DOOR ARRANGEMENT FOR A VEHICLE

[75] Inventor: Horst Klebba, Weyhausen, Germany

[73] Assignee: Volkswagenwerk Aktiengesellschaft, Wolfsburg, Germany

[22] Filed: June 2, 1975

[21] Appl. No.: 582,582

[30] Foreign Application Priority Data

July 15, 1974 Germany ..... 2433895

[52] U.S. Cl. ..... 49/503; 296/146

[51] Int. Cl.[2] ..... E06B 3/14

[58] Field of Search ..... 49/501, 503; 296/146

[56] References Cited

UNITED STATES PATENTS

| | | | |
|---|---|---|---|
| 1,214,892 | 2/1917 | Budd | 49/503 |
| 2,036,610 | 4/1936 | Sheriff | 296/146 |
| 3,718,364 | 2/1973 | Fischer et al. | 296/146 X |

*Primary Examiner*—Kenneth Downey
*Attorney, Agent, or Firm*—Brumbaugh, Graves, Donohue & Raymond

[57] ABSTRACT

A door arrangement for a vehicle has a door with one part of a lock assembly attached to one of its faces. This partial lock assembly cooperates with another part of the lock that is fixed in a zone on the door frame which is opposite the lock when the door is closed. The face of the door and the door frame form a door gap that is smaller in width than the distance between the facing lock components of the diverse lock assemblies. The door may be a hinged or a sliding door.

4 Claims, 5 Drawing Figures

DOOR ARRANGEMENT FOR A VEHICLE

BACKGROUND OF THE INVENTION

This invention relates to vehicle door locks and, more particularly, to vehicle door locks that will not jam in the event of a frontal impact on the vehicle.

Efforts are being made to design automobile doors in such a manner that they contribute to the strengthening of the vehicle body. This may be achieved in the case of a frontal impact by having the door brace the vertical columns of the vehicle, between which it is arranged, so that the passenger compartment experiences only a minor shortening of its length during a collision. However, with such an arrangement, a problem arises due to the forces generated in the direction of travel of the vehicle. In particular, the parts of the lock on the door may become deformed due to these longitudinal forces, thereby making it more difficult or even impossible to open the door after the accident.

SUMMARY OF THE INVENTION

It is the purpose of the present invention to create a door arrangement in which no significant damage is done to the parts of the door lock during a frontal impact. This purpose is attained in accordance with the invention in that the width of the door gap, measured in the horizontal direction approximately parallel to the door plane, is smaller than the distances between the lock parts measured in the same direction.

Due to the arrangement of the door in accordance with the present invention, the assemblies of the lock do not participate in the aforementioned bracing effect, but rather the bracing is achieved by mutual contact between regions of the door proper and the door frame. During an impact there will be a modification of the distances between the components forming the various lock assemblies at the same time as the decrease and elimination of the door gap. However, due to the fact that the distances between the lock parts are larger than the width of the door gap the parts of the door arrangement forming the door gap, namely the door face and the door frame, will come into contact with each other before the modification in the distances between the lock parts has progressed to the stage where damage is done to the lock.

In a preferred embodiment of the invention, the face of the door and/or the door frame zone have a recessed portion that carries the respective lock assemblies. The width of the door gap outside this recessed portion is made smaller than the distances between the respective lock assemblies. As a result, during a frontal impact, the door bears against the door frame only in zones that are situated outside the recessed lock area and not against the lock components. This occurs even though there are zones of the door face and door frame situated next to the lock which have a door gap with the same small dimensions.

Frequently at least one of the lock assemblies will be located opposite the support of the other assembly, i.e. the door face or the door frame. In such a case, the distances between the assemblies and the supports are made larger than the width of the door gap, in order to prevent compression of the lock assemblies in the event of a frontal impact.

In order to prevent the bracing surfaces of the door face and the door frame from becoming wedged in such a manner that opening of the door is no longer possible after a frontal impact, the door gap is at an outward angle in the horizontal plane so as to increase the width of the door as the outer surface of the door is approached. This creates an outward force component during a collision that will tend to force the door open. The size, as opposed to the angle, of the door gap is, however, kept at its small width with respect to the distances between the lock assembly components.

BRIEF DESCRIPTION OF THE DRAWINGS

The foregoing and other features of the present invention will be more readily apparent from the following detailed description and drawings in which.

DESCRIPTION OF AN EXEMPLARY EMBODIMENT

Figure 1:
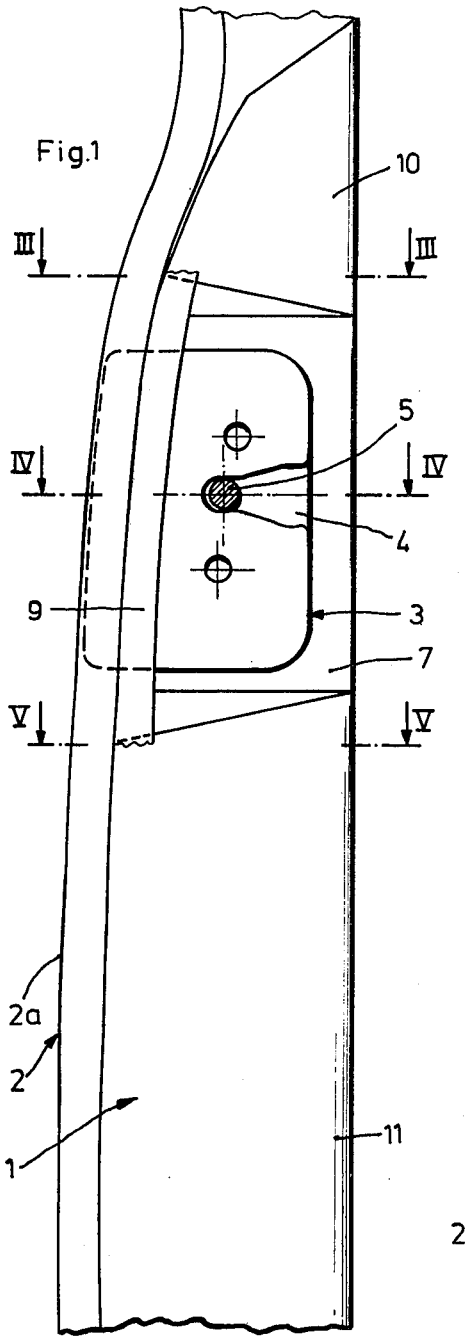
FIG. 1 is a view of a door face carrying a lock assembly for a passenger car.

The face plate 1 of the door 2 shown in FIG. 1 carries a lock assembly 3. In this example of the present invention the lock contains a turning latch, known per se and not shown here. A slot 4, open in the direction of the vehicle interior, serves to guide the door during its closing movement on a keeper 5 supported by the frame zone 6 (see FIG. 2) opposite the door face 1. Accordingly, the keeper 5 constitutes a part of the lock assembly that is attached to the frame.

Figure 2:
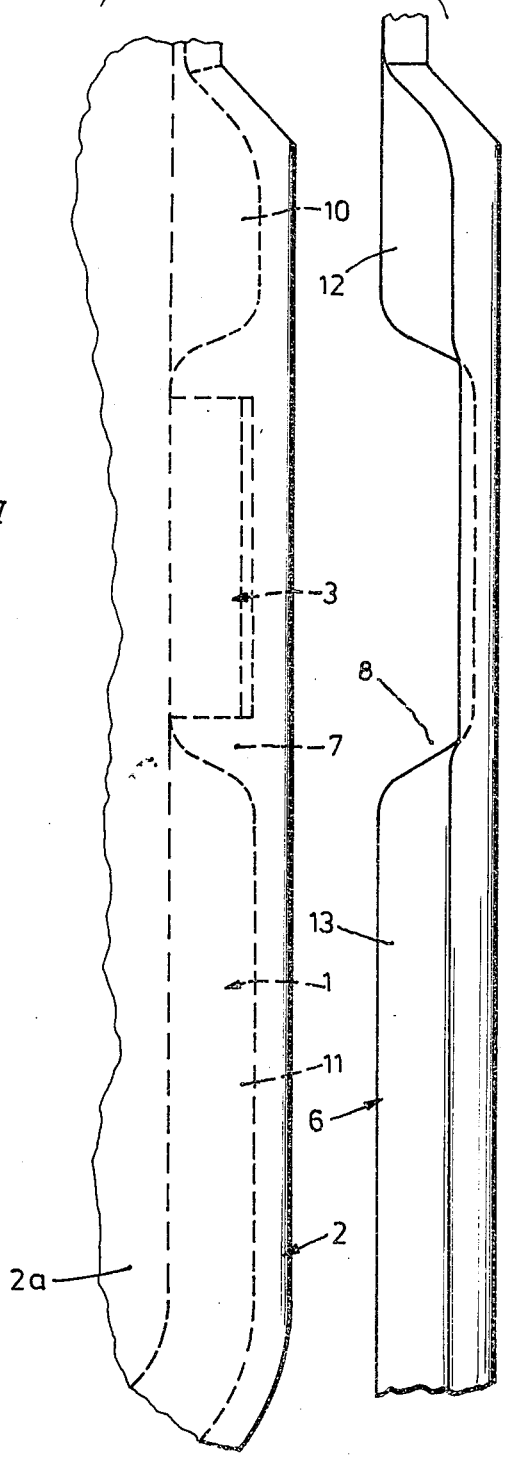
FIG. 2 represents a view of the door face and the door frame region from the outside and spaced somewhat farther apart than normal so that the details of the invention can be discerned more easily.

As may be seen specifically in FIG. 2, the lock asssembly 3 is placed in a recessed portion 7 of the door face 1. The door frame 6, also, is provided with a recessed portion 8 on this level. The individual zones of the door face as well as the lock assembly 3 are shown in FIG. 2 to be covered by an outer door plate **2*a* which, as may be seen in FIG. 4, is provided with a bent front region forming a chamber for the seal 9.** This bent front region also covers the door gap, at least in part.

Figure 3:
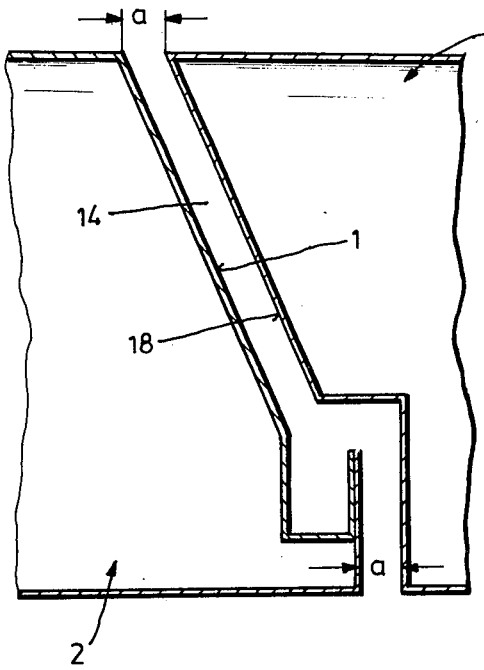
FIGS. 3–5 show the sectional views indicated in FIG. 1 by lines III—III, VI—VI, and V—V.

Above and below the lock assembly components 3 and 5 in FIGS. 1 and 2 are zones 10 and 11 of the door face 1, and 12 and 13, of the door frame 6. These zones form the door gap which is at an angle towards the outside of the vehicle or makes an angle with respect to the transverse axis of the door in the plane, i.e. the door gets wider as its outside surface is approached. FIGS. 3 and 5 show the slanted design of the door gap in horizontal cross sections where it is designated by 14. In FIG. 4 where the gap is not at an angle it is denoted by reference numeral 15. The term "door gap," should be understood in all cases to refer to the gap extending between the door face 1 and the opposite surface 18 of the door frame 6. The "width of the door gap" should always be understood to be the dimension of the door gap extending approximately parallel to the door plane in any horizontal plane and designated as *a* in FIGS. 3 and 5.

Figure 4:
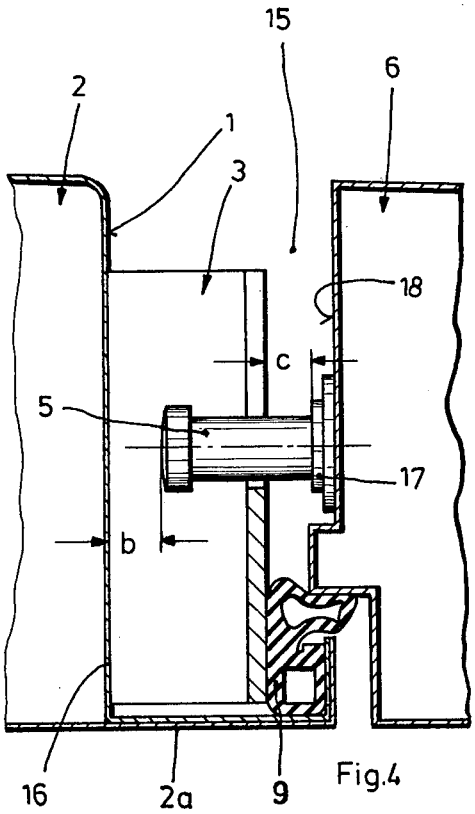
Figure 5:
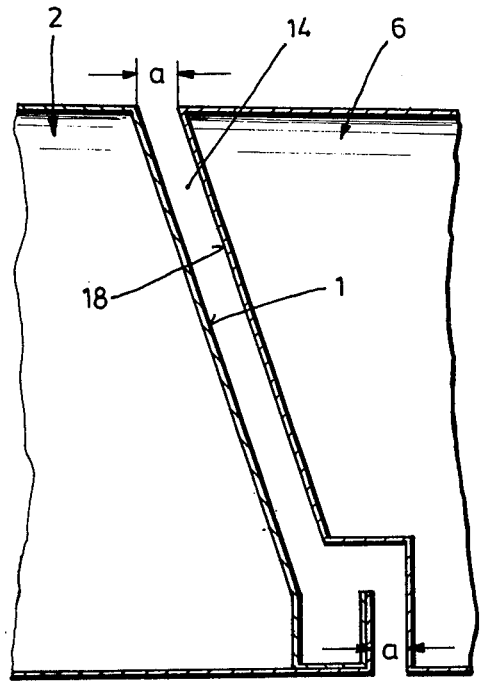

In FIG. 4, the distance *b* between the front end of the keeper and the base plate 16 of the lock assembly 3 and the distance *c* between the lock assembly 3 and the flange 17 of the keeper 5 represent the distances between lock components associated with the different lock assemblies. In accordance with the invention, these distances between lock components are made larger than the width *a* of the door gap 14 in the zones outside the recessed portions 7 and 8 of the door 2 and the frame 6. As a result of this dimensioning it is ensured that, in the event of a frontal impact causing the elimination of the door gap 14, only the surfaces 1 and 18, delimiting the door gap, come to bear on each other. The surfaces of lock components facing each other and associated with diverse lock assemblies, however, do not bear against each other. Accordingly, the bending of the keeper 5 or other lock components during such an accident becomes impossible and the lock remains intact, allowing the door to be opened.

The possibility that the door can be opened even after the door gap *a* has been eliminated, is enhanced in that the door gap in the horizontal planes is provided with the slanted regions shown in FIGS. 3 and 5. The size of the angle is chosen in such a manner that the door, as soon as its front face 1 has come into contact with the surface 18 of the frame, is subjected to a force diverting its front face 1 towards the outside, thereby aiding in the opening of the door.

The door gap has this slant in all regions, except for the region of the lock. There the recessed portions 7 and 8 that carry the assemblies of the lock are generally perpendicular to the door frame configuration. However, extending upward and downward from the recessed portions 7 and 8 are regions with nearly triangular cross-sections that initiate the slant of the door gap 14.

In cases where the lock assembly 3 is placed directly opposite components of the door frame 6, it is evident that the distance between the lock and the frame must be larger then the door gap 14 in the region outside the lock zone.

While the invention has been particularly shown and described with reference to a preferred embodiment thereof, it will be understood by those skilled in the art that various changes in form and details may be made therein without departing from the spirit and scope of the invention.

I claim:

1. A vehicle door arrangement including a door, a door frame and a lock assembly, with one part of the lock assembly attached to one of the edge faces of the door and the other part of the lock assembly attached to a zone of an edge face of the door frame that confronts the one edge face of the door when it is closed, the one door edge face and the confronting door frame edge face forming a door gap when the door is closed, and the lock components pertaining to the diverse parts of the lock assembly facing each other at certain distances when the door is closed, characterized in that, means for dimensioning the door arrangement in the region of the zone of the door frame are provided so that the minimum width of the door gap, at least outside said zone of the door frame edge face and measured in horizontal planes approximately parallel to the door plane, is smaller than the minimum distances between the lock components measured in the same directions.

2. The door arrangement as claimed in claim 1, characterized in that the means for dimensioning the door arrangement comprises a recessed portion of the door edge face that supports the one part of the lock assembly, the width of the door gap outside the recessed portion being smaller than the distances between the lock components.

3. The door arrangement as claimed in claim 1, characterized in that the means for dimensioning the door arrangement comprises a recessed portion of the zone of the door frame edge face that supports the other part of the lock assembly, the width of the door gap outside the recessed portion being smaller than the distances between the lock components.

4. The door arrangement as claimed in claim 1, characterized in that the door gap is at an angle to the transverse direction of the door so as to be slanted outwardly in horizontal cross sections in those zones in which its width is smaller than the distances between the lock components.

* * * * *